United States Patent [19]

Appelt

[11] Patent Number: 4,862,489

[45] Date of Patent: Aug. 29, 1989

[54] X-RADIATOR

[75] Inventor: Guenther Appelt, Erlangen, Fed. Rep. of Germany

[73] Assignee: Siemens Aktiengesellschaft, Berlin and Munich, Fed. Rep. of Germany

[21] Appl. No.: 152,235

[22] Filed: Feb. 4, 1988

[30] Foreign Application Priority Data

Feb. 20, 1987 [DE] Fed. Rep. of Germany ..... 3705544

[51] Int. Cl.[4] ..... H05G 1/54

[52] U.S. Cl. ..... 378/117; 378/118; 378/200

[58] Field of Search ..... 378/117, 118, 199, 200, 378/201, 202

[56] References Cited

U.S. PATENT DOCUMENTS

| | | | |
|---|---|---|---|
| 3,746,862 | 7/1973 | Lombardo et al. | 378/118 |
| 3,955,119 | 6/1976 | Perry et al. | 378/118 |
| 4,386,320 | 6/1983 | Lafrance | 378/117 |

FOREIGN PATENT DOCUMENTS

| | | |
|---|---|---|
| 738296 | 8/1943 | Fed. Rep. of Germany . |
| 402242 | 11/1933 | United Kingdom . |
| 556434 | 10/1943 | United Kingdom . |
| 834719 | 11/1957 | United Kingdom . |
| 2018019 | 10/1979 | United Kingdom . |

*Primary Examiner*—Carolyn E. Fields
*Assistant Examiner*—David P. Porta
*Attorney, Agent, or Firm*—Hill, Van Santen, Steadman & Simpson

[57] ABSTRACT

An x-radiator has a housing filled with electrically insulating fluid and having a radiation exit window, an x-ray tube disposed in the housing surrounded by the fluid and directing x-radiation through the exit window. During operation, the x-ray tube generates heat, causing an increase in pressure of the fluid in the housing. A protection circuit is provided which discontinues operation of the x-ray tube when the pressure of the fluid in the housing reaches a limit value. In order to prevent the protection circuit from unexpectedly discontinuing operation of the x-ray tube during a patient examination, the x-radiator also includes a warning circuit which generates a signal when the pressure of the fluid in the housing reaches a threshold level, the threshold level being below the limit value.

25 Claims, 3 Drawing Sheets

X-RADIATOR

BACKGROUND OF THE INVENTION

1. Field of the Invention

The present invention is directed to x-radiators having a housing filled with electrically insulating fluid with an x-ray tube therein, and having a protective device which discontinues operation of the x-radiator upon the occurrence of a fluid pressure in the housing which exceeds a limit value.

2. Description of the Prior Art

In x-radiators of the type having a housing filled with electrically insulating fluid, with an x-ray tube disposed in the housing surrounded by the fluid, it is known that the heat generated by the x-ray tube causes an increase in the pressure of the insulating fluid, therefore requiring a safety device to maintain the pressure rise occurring due to the dissipated heat within allowable limits. Such protective devices discontinue operation of the x-radiator, such as by disconnecting the x-ray tube from its high voltage source. Although such protective means are provided for safety reasons, the protective device may nonetheless create a risk in medical examinations, such as when the protective device responds during the examination of a patient, and unepxectedly places the x-radiator out of operation. Life-threatening situations for the patient can result, particularly when the x-ray system which includes the x-radiator is being used to monitor a catheterization.

SUMMARY OF THE INVENTION

It is an object of the present invention to provide an x-radiator having a protective circuit of the type described above which prevents endangering the patient due to the response of the protective means.

The above object is achieved in accordance with the principles of the present invention in an x-radiator having a warning device which generates a warning signal when the fluid pressure reaches a threshold level, which is below the limit value critical for the protective device. The threshold is selected such that the generation of the warning signal occurs an adequate time, for example, 30 minutes, before the anticipated response of the protective device, so that the operating personnel or the examining physican can determine whether an examination in progress can be completed in the remaining time, or whether the examination should be aborted for safety reasons. Endangering of the patient due to an unanticipated response of the protective device are thus not possible.

In one embodiment of the invention, the warning device includes a pressure sensor which measures the threshold of the liquid pressure. In a further embodiment, the same pressure sensor can be used as a sensor for the protective device, and measures the limit value of the fluid pressure.

Dependent on the use of the x-radiator, the time for which the x-radiator must be in operation during an examination can vary greatly. In a further embodiment of the invention, therefore, the threshold is adjustable. It is thus possible to adapt the time between the generation of the warning signal and the response of the protective means to the requirements of a particular examination. The threshold adjustment can be accomplished in an embodiment wherein the pressure sensor continuously generates a signal corresponding to the momentary value of the pressure, and the warning device includes means for comparing the signal corresponding to the momentary fluid pressure to a rated value corresponding to the threshold fluid pressure. Only the rated value must therefore be varied in order to vary the threshold.

In yet another embodiment of the invention the pressure sensor generates an output signal which changes discontinuously when the threshold of the fluid pressure is reached. In the simplest embodiment, the output signal of the pressure sensor can be used as the input (feed) voltage of an optical or acoustic signal device. The pressure sensor may be a pressure-sensitive switch, so that the input voltage is supplied to the optical or acoustic signal device to generate an optical or acoustic alarm when the threshold is reached.

In other embodiments of the invention, the pressure sensor may be directly exposed to the fluid pressure in the housing. Alternatively, if the x-radiator has a resilient wall section to compensate for volume changes caused by the changing temperature of the fluid, the pressure sensor may be indirectly actuated by the resilient wall section. The resilient wall section may be a membrane. The pressure sensor may be a switch which generates the warning signal when the resilient membrane causes the switch actuator to move a sufficient distance. The switch actuator may be variable in position relative to the resilient wall section to permit the threshold to be varied.

In those embodiments wherein the pressure sensor continuously generates an output signal corresponding to the fluid pressure in the housing, the warning device may include means for identifying and displaying the time remaining until the limit value of the fluid pressure is expected to be reached. In addition to the warning signal, the operating personnel will thus always be informed of the remaining operating time of the x-radiator before the expected response of the protective device.

DESCRIPTION OF THE PREFERRED EMBODIMENTS

Figure 1:
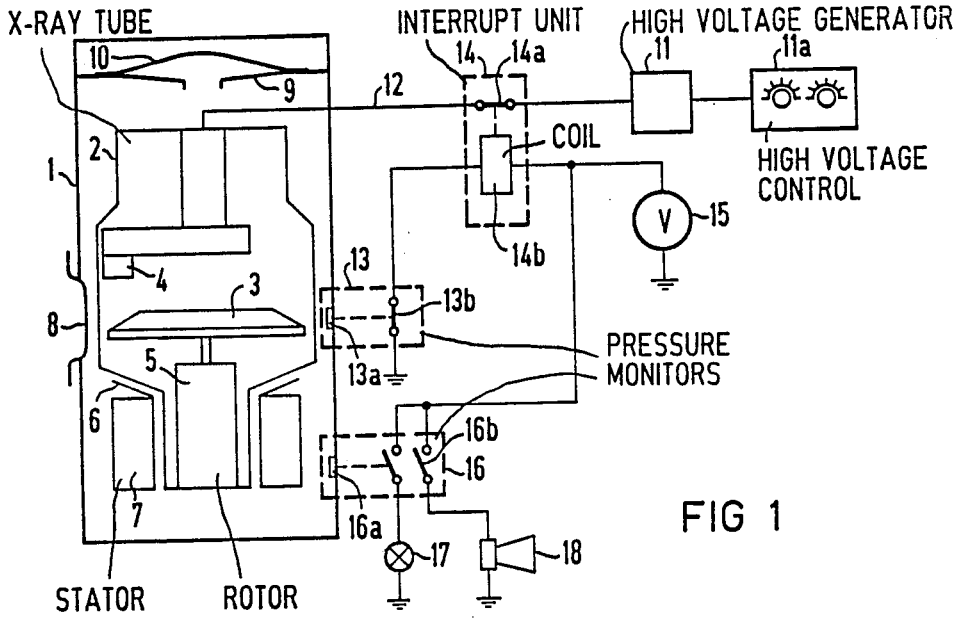
FIG. 1 is a schematic side view and a schematic circuit diagram of a first embodiment of an x-radiator constructed in accordance with the principles of the present invention.

An x-radiator constructed in accordance with the principles of the present invention is schematically shown in FIG. 1. The x-radiator includes a housing 1 filled with electrically insulating fluid, such as insulating oil. An x-ray tube 2 is disposed in the housing 1 surrounded by the insulating fluid. The x-ray tube in the embodiments shown herein is a rotating anode x-ray tube having an anode dish 3, a cathode 4, and a motor for driving the rotating anode. The motor includes a rotor 5 and a stator 7. The stator 7 is disposed outside of the glass envelope of the x-ray tube 2 mounted on an insulator 6. The housing 1 has a radiation exit window 8 to permit x-radiation to be emitted from the anode dish 3 to the exterior of the housing 1. The housing 1 has a resilient wall section, formed by a partition 9 having an opening therein covered with an outwardly arced elastic membrane 10, which closes the interior of the housing 1 in fluid-tight fashion below the partition 9. The elastic membrane 10 accommodates volume fluctuations of the insulating fluid caused by changing temperature inside the housing 1. The supply voltages required for operating the x-ray tube, namely the cathode filament voltage, the high-voltage and the voltage for driving the rotating anode are provided by a generator 11, with only a single line 12 being schematically shown between the generator 11 and the x-ray tube 2 for clarity. The generator 11 has a control panel 11a by means of which the operating values for the x-ray tube 2 can be set, and by means of which the x-radiator can be placed in operation.

During operation of the x-radiator, the x-ray tube 2 generates substantial heat, which is dissipated in the surrounding fluid. To maintain the rise in the fluid pressure in the housing 1 as a consequence of this heating below a limit value for safety reasons, the x-radiator has a protection device which discontinues operation of the x-radiator in the event of the fluid pressure in the housing 1 exceeding the limit value. The protection device includes a pressure monitor 13, such as a pressure-sensitive switch having a pressure sensor 13a and a switch contact 13*b*. The pressure monitor 13 is attached to the housing 1 so that the pressure sensor 13*a*, which actuates the switch contact 13*b*, is directly exposed to the fluid pressure in the interior of the housing 1. The protection device further includes an interrupt unit 14, which connects and disconnects the x-ray tube 2 to the voltage generator 11. The interrupt unit 14 has a plurality of contacts such as contacts 14*a*, and an excitation coil 14*b* connected to a voltage source 15. The circuit including the coil 14*b* is completed when the contact 13*b* of the pressure monitor 13 is closed.

The protection device operates so that the contact 14*a* of the interrupt unit 14 is closed, and the x-ray tube 2 is connected to the voltage generator 11 and can be operated with operating data set at the control panel 11*a*, as long as the fluid pressure in the housing 1 is below the limit value. As soon as the fluid pressure in the interior of the housing 1 exceeds the limit value, the switch contact 13*b* of the pressure monitor 13 opens, the coil 14*b* is no longer energized, and the contact 14*a* opens, so that operation of the x-radiator is discontinued.

When, due to cooling of the x-radiator, the fluid pressure inside the housing 1 falls below the limit value, the switch contact 13*b* again closes, whereupon the coil 14*b* is again energized and the contact 14*a* is closed, so that the x-radiator is again ready for operation.

In order to draw attention to the impending response of the protection device, the x-radiator of the invention includes a warning device which generates a warning signal at a threshold of the fluid pressure in the housing 1 which is below the limit value critical for the protection device. In the exemplary embodiment of FIG. 1, the warning device includes a second pressure monitor 16, which again may be a pressure-sensitive switch, having a pressure sensor 16*a* attached to the inside wall of the housing 1 and directly exposed to the fluid pressure prevailing in the housing 1. The pressure monitor 16 also includes a double-pole switch contact 16*b* which closes when the threshold of the fluid pressure inside of the housing 1 is reached, causing a warning lamp 17 and an acoustic signal generator 18 to be connected to the voltage source 15. The threshold at which the warning device responds is selected dependent on the intended use of the x-radiator, so that the warning signal is generated at a time sufficiently long before the expected response of the protection device, to permit operating personnel to make a decision whether the intended examination can still be started, or whether an examination already in progress can be completed or should be aborted for safety reasons.

Figure 2:
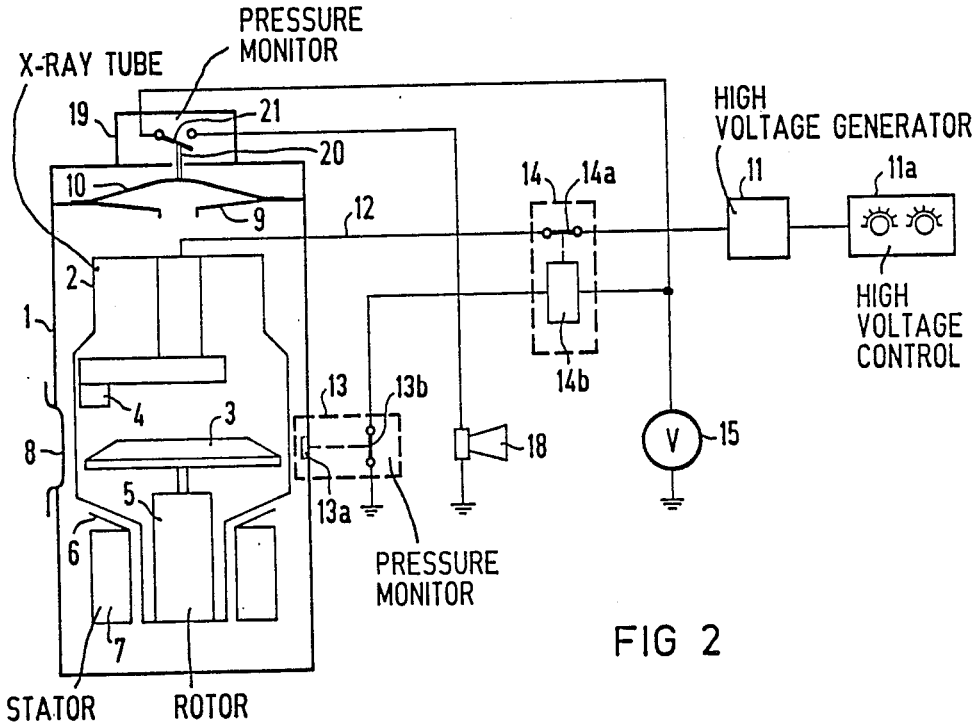
FIG. 2 is a schematic side view and a schematic circuit diagram of a second embodiment of an x-radiator constructed in accordance with the principles of the present invention.

The exemplary embodiments of FIG. 2 differs from the embodiments of FIG. 1 in that the pressure monitor 19 for the warning devices measures the fluid pressure in the housing 1 by measuring the volume of the fluid contained in the housing 1. The pressure monitor 19 is a touch contact and is actuated by movement of the membrane 10, which expands as the fluid pressure in the housing 1 increases. The membrane 10 acts on an actuator 20 eventually causing a switch contact 21 to close when the threshold is reached. This again connects a warning signal generator, such as an acoustic signal generator 18, to the voltage supply 15.

Figure 3:
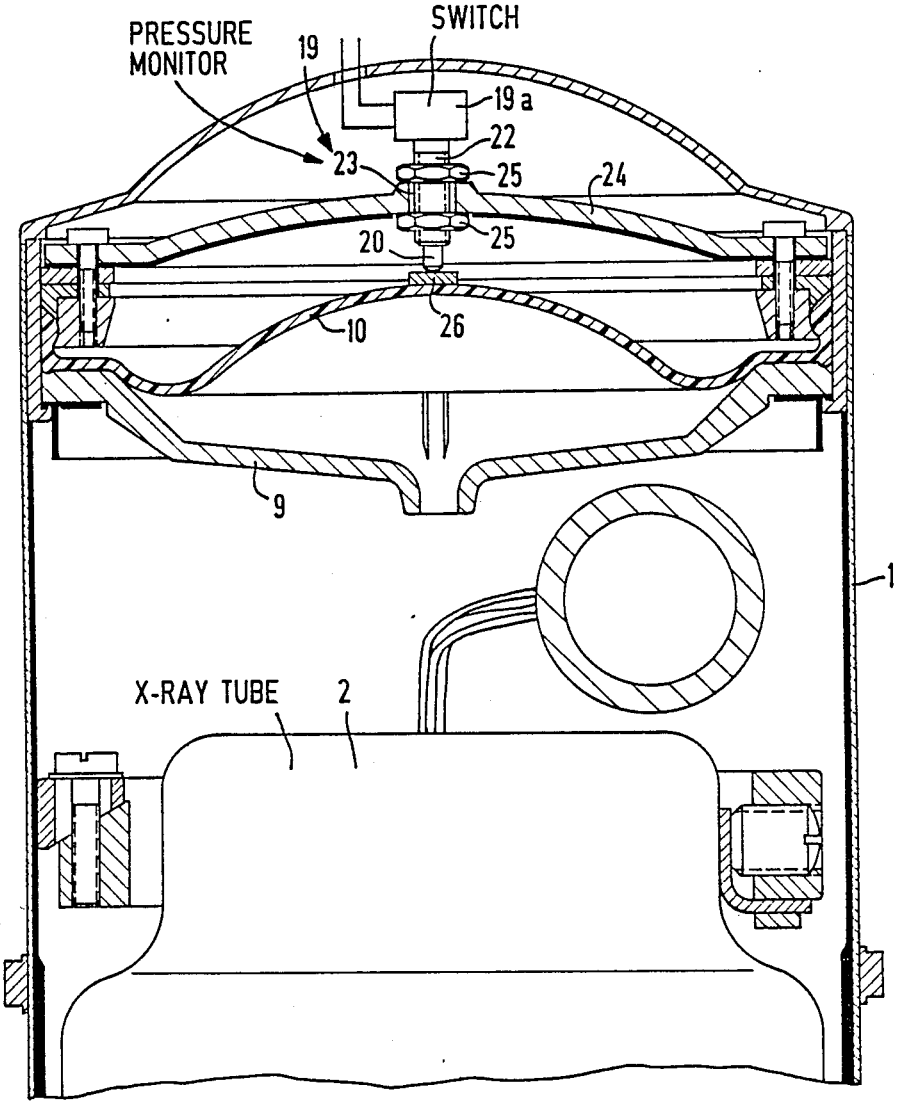
FIG. 3 is an enlarged side sectional view of a portion of the x-radiator shown in FIG. 2.

Further details of the pressure monitor 19 are shown in the enlarged view of FIG. 3. The touch contact 19*a* of the pressure monitor 19 has a threaded projection 22 which surrounds the actuator 20 and which extends through a bore 23 of a mount 24 (which may be a component of the housing 1) and is held in place by nuts 25. To set the threshold of the pressure at which the switch contacts 21 (not shown in FIG. 3) will be closed, and thus the time at which a warning signal is generated, the position of the actuator 20 relative to the membrane 10 can be varied by adjusting the nuts 25. The threshold of the fluid pressure at which the warning device responds will be lower as the position of the actuator 20 is adjusted in the direction toward the membrane 10. To avoid damage to or wear of the membrane 10, the membrane 10 may be provided with a protective element 26 at the location of engagement with the actuator 20.

Figure 4:
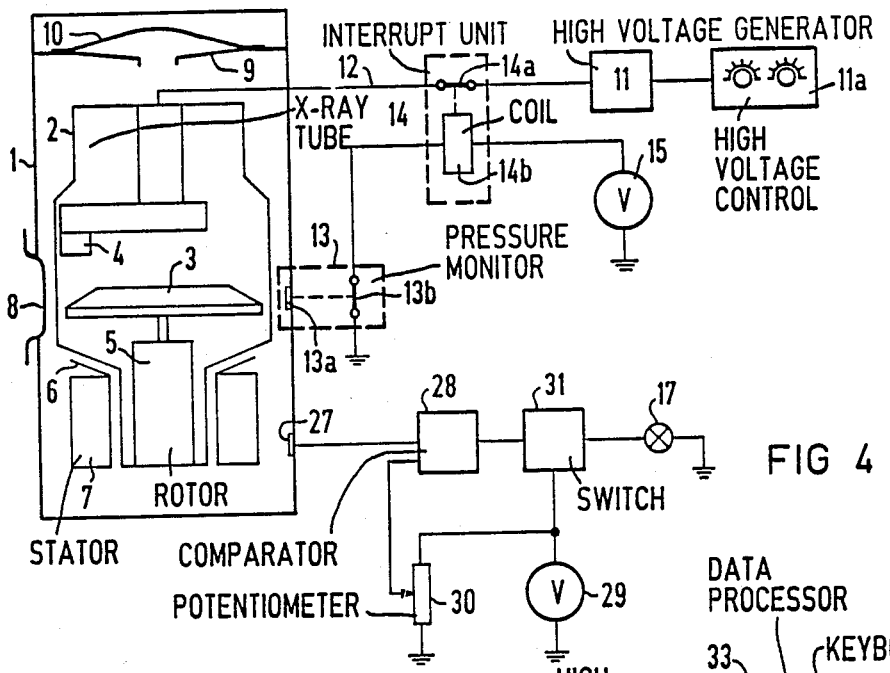
FIG. 4 is a schematic side view and a schematic circuit diagram of a third embodiment of an x-radiator constructed in accordance with the principles of the present invention.

The x-radiator of FIG. 4 differs from the embodiments described above in that the pressure sensor 27 of the warning device continuously generates a signal corresponding to the momentary value of the fluid pressure in the housing 1. The pressure sensor 27 may, for example, be a piezo-electric sensor. The warning device also includes a comparator 28, which may be an operational amplifier wired as a comparator. The warning device also includes a voltage source 29 with a potentiometer 30 connected thereto. The wiper of the potentiometer 30 taps a voltage which represents a rated value corresponding to the threshold of the fluid pressure. This voltage is supplied to one input of the comparator 28, and the signal voltage from the pressure sensor 27 is supplied to the other input of the comparator 28. As soon as the fluid pressure inside of the housing 1 exceeds the threshold, and thus the voltage supplied by the pressure sensor 27 exceeds the rated value set by the potentiometer 30, the output signal of the comparator 28 changes. This controls a switch 31 which causes a warning signal generator, such as a warning lamp 17, to be connected to a voltage source 29. The switch 31 may be a conventional electromechanical relay, or may be a semiconductor switch. If necessary, an amplifier for the voltage generated by the pressure sensor 27 can be provided between the pressure sensor 27 and the corresponding input of the comparator 28.

The voltage set by the potentiometer 30, and serving as the rated value, is selected so as to always be below the voltage corresponding to the limit value of the fluid pressure inside of the housing 1, which determines the response of the protection device. This can be achieved either by a suitable selection of the voltage supplied by the voltage source 29, or by a suitably dimensioned drop resistor (not shown in FIG. 4) in series with the potentiometer 30. The threshold at which the warning device in the embodiment of FIG. 4 responds can thus be easily varied, thus permitting the time which elapses between the response of the warning device and the response of the protection means to be adapted to the particular requirements of different examinations in a simple manner.

Figure 5:
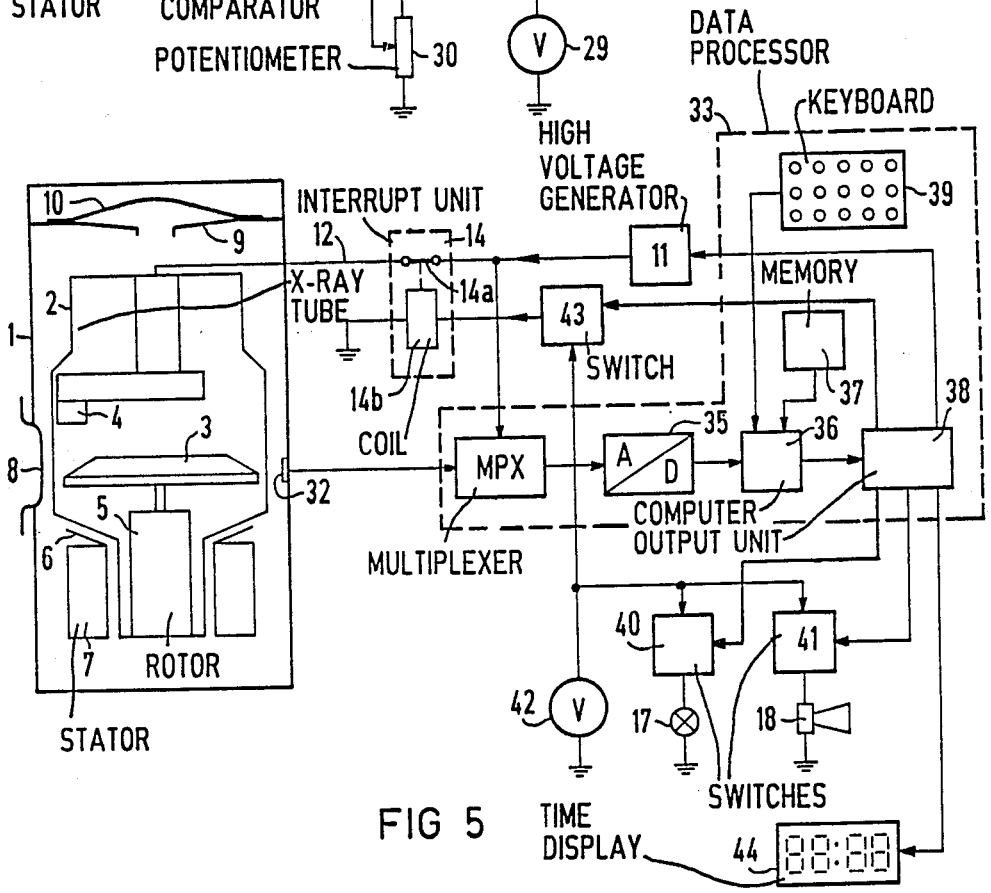
FIG. 5 is a schematic side view and a schematic circuit diagram of a fourth embodiment of an x-radiator constructed in accordance with the principles of the present invention.

Another embodiment of an x-radiator constructed in accordance with the principles of the present invention is shown in FIG. 5, wherein a single pressure sensor is provided in common as part of both the warning device and the protection device. A data processor 33 is also provided, which is also a part of both the warning device and the protection device. The data processor 33 initiates the generation of a warning signal when the fluid pressure inside the housing 1 exceeds the threshold value, and discontinues operation of the x-radiator when the fluid pressure inside the housing 1 exceeds the limit value.

The data processor 33 includes a multiplexer 34, and analog-to-digital converter 35, a computer 36, a memory 37, an output unit 38, and a keyboard 39.

The keyboard 39 is connected to the computer 36 to permit entry of the limit value and the threshold level of the fluid pressure in the housing 1. These values are stored in the memory 37 and are available to the computer 36. The keyboard 39 also permits selection of the operating data for the x-radiator, with the computer 36 acting, based on the entered data, via the output unit 38 on the voltage generator 11, thereby providing the appropriate voltages for the x-ray tube 2. The voltages supplied by the generator 11 are also supplied to the multiplexer 34. The output signal from the pressure sensor 32 is also supplied to the multiplexer 34. From the multiplexer 34, these signals serially proceed via the analog-to-digital converter 35 to the computer 36. The computer 36 constantly compares the momentary fluid pressure inside of the housing 1 to the values for the limit value or the threshold level. As soon as the fluid pressure in the housing 1 exceeds the threshold level, the computer 36 causes switches 40 and 41 to connect a signal lamp 17 and an acoustic generator 18 to a voltage source 42. When the fluid pressure in the housing 1 exceeds the limit value, the computer 36 operates a switch 43 via the output unit 38 to disconnect the excitation coil **14*b* of the interrupt unit 14 from the voltage source 42, so that the contact 14*a* of the interrupt unit 14 opens and the x-ray tube 2 is disconnected from the generator 11**, thereby ceasing operation of the x-radiator.

From the momentary value of the fluid pressure and from the values for the operating data of the x-ray tube 2 supplied via the multiplexer 34 and the analog-to-digital converter 35, the computer 36, also using the entered and stored limit value of the fluid pressure, constantly re-calculates the time remaining until the limit value of the fluid pressure will be reached, and displays this time on a time display 44 via the output unit 38.

Calculation of the time remaining until the expected response of the protection device is based on the perception that the momentary fluid pressure in the housing 1 and the limit value of the fluid pressure have certain temperatures allocated thereto. The difference between these temperatures has a specific quantity of heat allocated thereto, this being the heat required to elevate the temperature of the insulating oil in the housing 1 from the temperature corresponding to the momentary fluid pressure to the temperature corresponding to the limit value of the fluid pressure. Because the dissipated heat generated per unit of time can also be calculated from the operating data of the x-ray tube 2, it is possible to calculate the time remaining until the limit value of the fluid pressure is expected to be reached, i.e., until the response of the safety circuit. The lengthening of this time as a consequence of the amount of heat emitted to the environment by the x-radiator can also be taken into consideration with a simple iteration process.

The time remaining until the response of the protection device given the set operating data of the x-ray tube 2 appear on the time display 44. If the operating data of the x-ray tube 2 are changed in a manner which has an influence on the dissipated heat generated by the x-ray tube 2 per unit of time, this is immediately taken into consideration in the calculation of the remaining time, so that correct information can always be derived from the time display 44, even given changes in the operating data of the x-ray tube 2 during the examination.

Although modifications and changes may be suggested by those skilled in the art it is the intention of the inventor to embody within the patent warranted hereon all changes and modifications as reasonably and properly come within the scope of his contribution to the art.

I claim as my invention:

1. An x-radiator comprising:

a housing filled with electrically insulating fluid and having a radiation exit window;

an x-ray tube disposed in said housing surrounded by said fluid and directing x-radiation through said radiation exit window, said x-ray tube generating heat during the operations thereof causing an increase in pressure of said fluid in said housing;

protection means for discontinuing operation of said x-ray tube when a monitored pressure of said fluid in said housing reaches a limit value; and warning means separate from said protection means for generating a signal when the pressure of said fluid in said housing reaches a threshold level, said threshold level being below said limit value.

2. An x-radiator as claimed in claim 1, wherein at least said warning means includes means for measuring the pressure of said fluid in said housing and generator an electrical signal corresponding thereto.

3. An x-radiator as claimed in claim 2, wherein said means for measuring generates a discontinuous electrical signal when said threshold is reached.

4. An x-radiator as claimed in claim 1, further comprising means for selectively adjusting said threshold level.

5. An x-radiator as claimed in claim 1, further comprising:

means for continuously monitoring the pressure of said fluid in said housing and generating a continous electrical signal corresponding to the momentary pressure of said fluid; and means for comparing said signal to a value corresponding to said threshold level.

6. An x-radiator as claimed in claim 1, further comprising means for computing the remaining length of time following generation of said warning signal until said limit value is estimated to be reached; and means for displaying said remaining length of time.

7. An x-radiator as claimed in claim 1, wherein at least said warning means includes means for measuring the pressure of said fluid by measuring the volume of said fluid in said housing and generating an electrical signal corresponding thereto.

8. An x-radiator as claimed in claim 7, wherein said means for measuring the pressure of said fluid by measuring the volume of said fluid in said housing includes means for generating a discontinuous electrical signal when said threshold level is reached.

9. An x-radiator as claimed in claim 7, wherein said housing has a resilient wall section moveable in response to expansion of said fluid in said housing caused by the heat generated during operation of said x-ray tube, and wherein said means for measuring the pressure of said fluid by measuring the volume of said fluid in said housing includes an actuatable element in contact with said resilient wall section.

10. An x-radiator as claimed in claim 9, wherein said resilient wall section is an elastic membrane.

11. An x-radiator as claimed in claim 10, wherein said actuatable element is a switch having an actuator in contact with said resilient wall section.

12. An x-radiator as claimed in claim 11, further comprising means for selectively adjusting the position of said actuator relative to said resilient wall section.

13. An x-radiator as claimed in claim 1, wherein each of said protection means and said warning means has a respective means for monitoring the pressure of said fluid in said housing.

14. An x-radiator as claimed in claim 13, wherein each respective means for monitoring is a pressure sensor.

15. An x-radiator as claimed in claim 1, wherein said protective means and said warning means share a common means for monitoring the pressure of said fluid in said housing.

16. An x-radiator as claimed in claim 15, wherein said common means for monitoring is a pressure sensor.

17. An x-radiator comprising:

a housing filled with electrically insulating fluid and having a radiation exit window;

an x-ray tube disposed in said housing surrounded by said fluid and directing x-radiation through said radiation exit window, said x-ray tube generating heat during the operation thereof causing an increase in pressure of said fluid in said housing;

first means for monitoring the pressure of said fluid in said housing;

protection means connected to said first means for monitoring the pressure for discontinuing operation of said x-ray source when the pressure of said fluid in said housing reaches a limit value;

second means for monitoring the pressure of said fluid in said housing;

warning means separate from said protection means connected to said second means for monitoring the pressure for generating a signal when the pressure of said fluid in said housing reaches a threshold level, said threshold level being below said limit value.

18. An x-radiator as claimed in claim 17, wherein each of said first and second means for monitoring pressure is a pressure sensor.

19. An x-radiator comprising:

a housing filled with electrically insulating fluid and having a radiation exit window;

an x-ray tube disposed in said housing surrounded by said fluid and directing x-radiation through said radiation exit window, said x-ray tube generating heat during the operation thereof causing expansion and an increase in pressure /of said fluid in said housing;

means for sensing the pressure of said fluid in said housing;

protection means connected to said means for sensing pressure for discontinuing operation of said x-ray source when the pressure of said fluid in said housing reaches a limit value;

means for measuring the volume of said fluid in said housing; and warning means separate from said protection means connected to said means for measuring the volume of said fluid for generating a signal when the volume of said fluid reaches a threshold level, said threshold level corresponding to a pressure which is below said limit value.

20. An x-radiator comprising:

a housing filled with electrically insulating fluid and having a radiation exit window;

an x-ray tube disposed in said housing surrounded by said fluid and directing x-radiation through said radiation exit window, said x-ray tube generating heat during the operation thereof causing an increase in pressure of said fluid in said housing;

a single means for sensing the pressure of said fluid in said housing;

protection means connected to said means for sensing pressure for discontinuing operation of said x-ray source when the pressure of said fluid in said housing reaches a limit value; and warning means separate from said protection means connected to said means for sensing pressure for generating a signal when the pressure of said fluid in said housing reaches a threshold level, said threshold level being below said limit value.

21. An x-radiator as claimed in claim 19, wherein said means for sensing pressure generates an electrical signal corresponding to the sensed pressure, and further comprising means for alternatingly comparing said electrical signal to a value corresponding to said limit value and to a value corresponding to said threshold level.

22. An x-radiator as claimed in claim 20, further comprising means for computing the remaining length of time following generation of said signal by said warning means until said limit value is estimated to be reached; and means for displaying said remaining time.

23. An x-radiator as claimed in claim 22, for use with a voltage generator having an output supplied to said x-ray tube, and further comprising multiplexer means for alternatingly supplying said electrical signal and the output of said voltage generator to said means for computing, said means for computing using the value of the output of said voltage generator in computing the remaining length of time.

24. A method for operating an x-radiator having an x-ray tube disposed in a housing filled with electrically insulating fluid, said x-ray tube generating heat during the operation thereof causing an increase in pressure of said fluid in said housing, said method comprising the steps of:

monitoring the pressure of said fluid in said housing;

discontinuing operation of said x-ray source when the pressure of said fluid in said housing reaches a limit value;

generating a warning signal when the pressure of said fluid in said housing reaches a threshold level, said threshold level being below said limit value;

computing the remaining length of time following generating said warning signal until said limit value is estimated to be reached; and displaying said remaining length of time.

25. A method as claimed in claim 24, wherein said x-radiator is used with a voltage generator which supplies operating voltages to said x-radiator, and comprising the additional steps of:

monitoring any changes in said operating voltages;

determining the amount of change in pressure if any, which a change in said operating voltages will have on the pressure of said fluid in said housing; and computing said remaining length of time based at least in part on the amount of change in pressure of said fluid contributed by said voltage changes.

* * * * *